US005275227A

United States Patent [19]

Staub

[11] Patent Number: 5,275,227

[45] Date of Patent: Jan. 4, 1994

[54] CASTING PROCESS FOR THE PRODUCTION OF CASTINGS BY DIRECTIONAL OR MONOCRYSTALLINE SOLIDIFICATION

[75] Inventor: Fritz Staub, Seuzach, Switzerland

[73] Assignee: Sulzer Brothers Limited, Winterthur, Switzerland

[21] Appl. No.: 51,256

[22] Filed: Apr. 21, 1993

Related U.S. Application Data

[63] Continuation of Ser. No. 754,540, Sep. 4, 1991, abandoned.

[30] Foreign Application Priority Data

Sep. 21, 1990 [CH] Switzerland ..... 03061/90

[51] Int. Cl.[5] ..... B22D 27/04

[52] U.S. Cl. ..... 164/122.1; 164/338.1; 164/361

[58] Field of Search ..... 164/122.1, 122.2, 361, 164/338.1

[56] References Cited

U.S. PATENT DOCUMENTS 2,943,007 6/1960 Walter et al. ..... 148/2
3,926,245 12/1975 Kanaby ..... 164/53
4,966,225 10/1990 Johnson et al. ..... 164/361

FOREIGN PATENT DOCUMENTS 0126550 11/1984 European Pat. Off. .
2443302 7/1980 France .
2056342 3/1981 United Kingdom .
2195277 4/1988 United Kingdom .

OTHER PUBLICATIONS

Fonderie, No. 12, Feb. 1982, Paris, France, M. H. Khan: "La Solidification Dirigee", pp. 17-23.
Metals Handbook, Ninth Edition, vol. 15, Casting, 1988, pp. 319-323 and 400-401.

*Primary Examiner*—Kuang Y. Lin
*Attorney, Agent, or Firm*—Kenyon & Kenyon

[57] ABSTRACT

A process for the production of castings by directional or monocrystalline solidification is carried out in a vacuum casting plant which, apart from a conventional cooling plate, has no additional heating devices for the casting mold. The unidirectional heat flow required to guide the solidification front is produced on the one hand, by heat sources formed partially from superheated melt and, on the other hand, by heat sinks consisting of the cooling plate and the surroundings of the mold. The mold is heated in a separate heating-up oven to a temperature above the liquidus temperature of the melt in order that the casting mold may contribute to the heat source in addition to the melt so doing.

9 Claims, 2 Drawing Sheets

10
11
12
13
2a
2b
1
7
6
5
15
3
3a
3b
200
205
210
220
301
302
303
304
50
56

CASTING PROCESS FOR THE PRODUCTION OF CASTINGS BY DIRECTIONAL OR MONOCRYSTALLINE SOLIDIFICATION

This application is a continuation of U.S. application Ser. No. 07/754,540, filed Sep. 4, 1991, now abandoned.

This invention relates to a casting process for the production of castings by directional or monocrystalline solidification. More particularly, this invention relates to a casting mold for performing the process.

Various known nickel base alloys for which directional solidification is possible on casting are suitable for the production of cast components which are highly stressed mechanically at high temperatures, e.g., aircraft engine turbine blades. When the melt of an alloy of this kind solidifies, dendritic crystals form. Unless special steps are taken, seed crystals generally form at different places during the cooling of the cast melt and result in polycrystalline solidification. In order to avoid this, a solidification front whose extent can be controlled by a "unidirectional" heat flow can be developed by a special arrangement of heat sinks and heat sources and by controlled initiation of the crystallization. Columnar crystals form during this directional solidification. If a special starting phase is used for the solidification (e.g. by means of a "selector"), it is also possible to allow the casting to grow in the form of a monocrystal.

Various processes are known for the production of castings by directional or monocrystalline solidification. A common feature of these processes is that a ceramic mold is used, which is open top and bottom-at the top, to enable a melt to be poured in; and at the bottom to receive a cooling plate with which the melt comes into direct contact. If relatively large components are to be produced, it is necessary to use an expensive special construction of a vacuum casting plant. In a special casting plant of this kind, the unidirectional heat flow is generated and maintained by means of an additional heating system as a heat source together with the cooling plate acting as a heat sink. The solidification front can be guided through the component from the bottom to the top by means of a lowering device for the cooling plate and the mold. The relative movement between the mold and the additional heating means can also be obtained by moving the heating elements. Such methods provide good control of the temperature gradient G in the area of the solidification front, and the speed v at which the dendritic crystals grow. The dendritic structure, more particularly the distance between adjacent dendrites, depends on these values G and v.

In other processes, which can be performed in simple vacuum casting plants intended for various applications, the heat sources are no longer produced by heating elements but by a superheated melt and by a special configuration of the mold by incorporating additional cavities therein. These cavities filled with superheated melt have the function of heat reservoirs. Apart from the advantage of being cheaper relative to the casting plant, these "processes with heat reservoirs integrated into the mold shell" have the disadvantage of requiring more alloy. In addition, to enable the temperature gradient G and the solidification speed v to be controllable, a restricted range of application has to be accepted. This parameter control is possible successfully only in respect of the required dendrite structure only if the components are not too large, i.e. not more than about 15 centimeters (cm) in length. On the other hand, another important advantage of the second type of process is that the period during which the vacuum casting plant is occupied for a casting is about five times shorter.

Swiss Patent 641985 and U.K. published application 2 056 342 disclose a process of the second type mentioned above, in which the heat reservoir integrated into the mold shell is formed by the casting hopper. In this process, the casting mold is covered by a covering of heat-insulating material, the object of which is that a linear heat flow should form vertically so that the solidification front may move upwardly in parallel to the cooling plate. In addition, the casting mold is preheated independently of the melt to a temperature of about 1200° C. An essential characterizing feature of Swiss Patent 641985 is indicated as being the fact that it is not necessary to preheat the casting mold to a temperature above the liquidus temperature, which is between 1300° and 1400° C., to carry out directional solidification, since the final heating after preheating to about 1200° C. can be performed by the superheated melt. However, this process has the disadvantage that additional melt must be made available for mold heating.

The process using a heat source integrated into the mold shell has been developed further. Instead of the unidimensional alignment of the heat flow, which results in a linear solidification process, a heat flow which allows a multi-dimensional solidification process is produced by special configuration and arrangement of the cavities for the heat reservoirs.

Accordingly, it is an object of the invention to develop the process having a heat source integrated into the mold shell so that the amount of melt required for the heat reservoirs can be reduced.

It is another object of the invention to provide a simplified process for the production of castings by directional solidification.

It is another object of the invention to provide a simplified apparatus for casting alloys.

Briefly, the invention provides a casting process in which an insulated mold for a casting is heated to a temperature at least 50° K higher than the liquidus temperature of the mold to be cast prior to casting.

In accordance with the process, a superheated melt of the casting material is separately formed, for example in a vacuum casting plant, while the mold is heated in an oven separate from the vacuum casting plant. Thereafter, the heated mold is placed on a cooling plate defining a heat sink, for example, within an air lock of the vacuum casting plant. Subsequently, the superheated melt is poured into the heated mold and a controlled heat flow is produced from the melt and the mold to the mold surroundings for guiding a solidification front from a bottom to a top of the mold.

The mold is constructed so as to form a plurality of individual component molds with each component mold being in communication with a selector at the base to effect a columnar crystallization.

These and other objects and advantages of the invention will become more apparent from the following detailed description taken in conjunction with the accompanying drawings wherein.

Figures 1, 2, 3A, 3B:
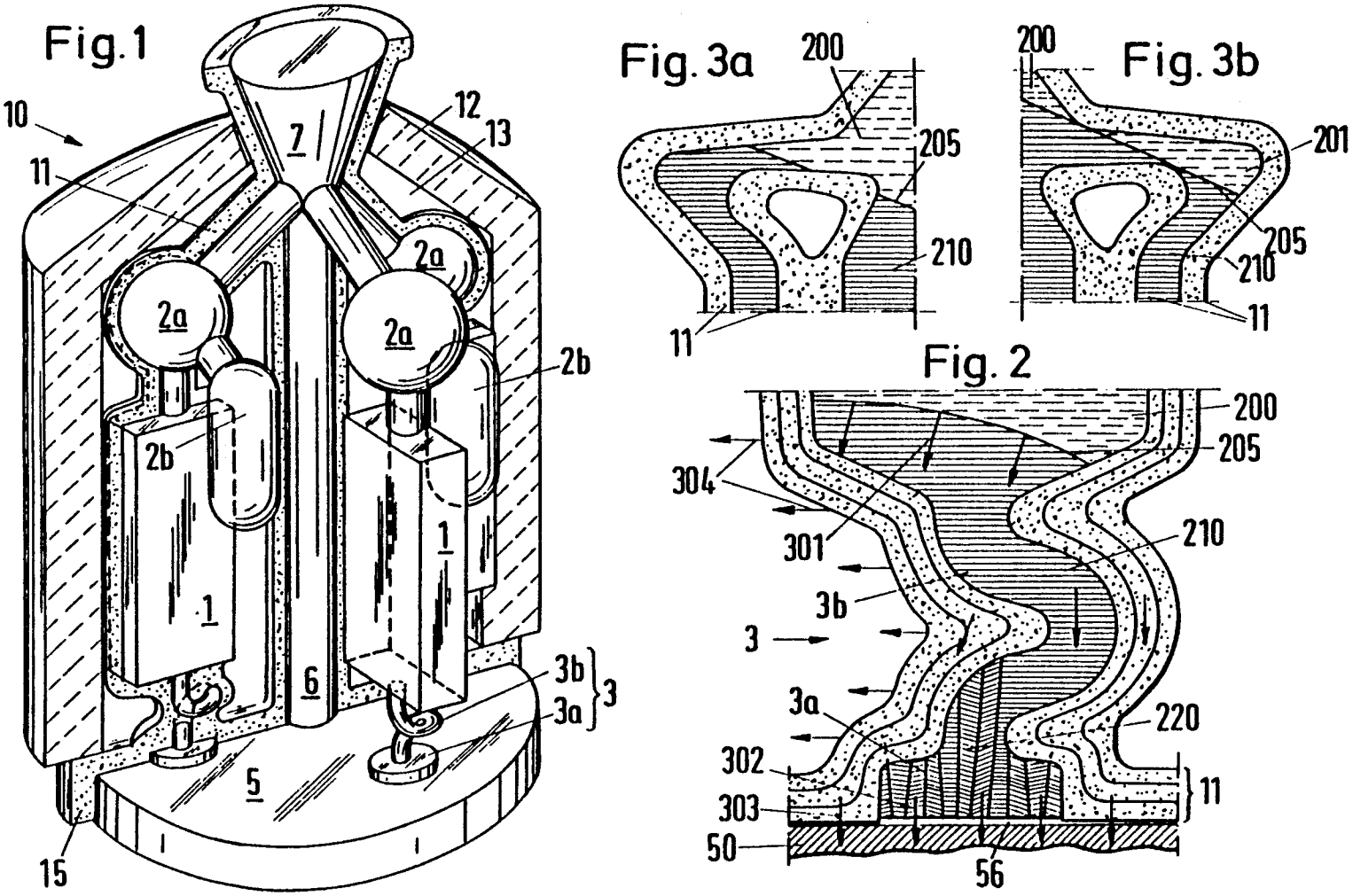
FIG. 1 illustrates a construction of a casting mold with four identical components arranged in the form of a cluster after the style of a bunch of grapes in accordance with the invention.
FIG. 2 illustrates a simplified longitudinal section through a "selector" constructed in accordance with the invention.
Figure 4:
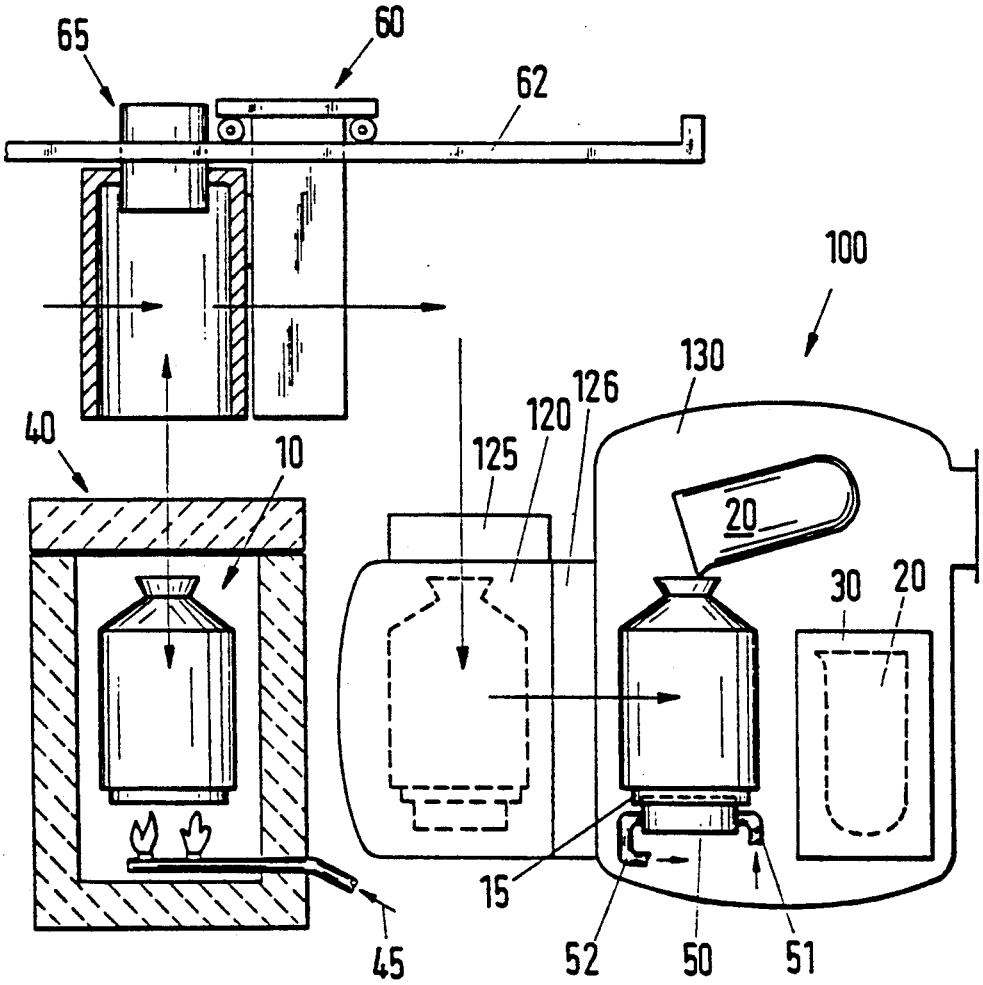

FIG. 3*a* illustrates a cross-sectional view of a mold in which a solidification front is formed in accordance with the invention;

FIG. 3*b* illustrates a view similar to FIG. 3*a* of a solidification front curve which is to be avoided; and FIG. 4 diagrammatically illustrates a plant for performing the process according to the invention.

FIG. 1 is a perspective view of one half of a casting mold 10 comprising a mold shell Il and an insulating cover 12. In the other half, shell cavities are shown in the form of the wax model used to make the sell 11. The following cavities which are shown in three-dimensional form are visible: the component mold 1 for a single part, which is shown as a block in a highly simplified form; cavities 2*a*, 2*b* for heat reservoirs formed by a superheated melt; a starter 3 with a disc-shaped base zone 3*a* and a helical selector 3*b*; a cavity 5 which, during casting, is occupied by a cooling plate; a volume 6 of the central stem which, after the wax has been melted out, is closed with ceramic material; and finally a casting hopper 7.

The shell 11 has a ring 15 at the periphery of the cavity 5, and has grooves (not shown) on the inside formed by appropriate configuration of the wax model. These grooves enable the mold 10 to be secured on a cooling plate in the style of a bayonet catch. The insulating cover 12 can be formed from ceramic fiber mats with the space 13 between the shell 11 and the cover 12 preferably filled with heat-insulating material, e.g. a ceramic wadding.

FIG. 2 is a longitudinal section through the starter 3 just after a melt 200 has started to solidify, the section being directed radially with respect to the centrally symmetrical mold 10 and the center being situated on the right-hand side. For the sake of clarity, the helical selector 3*b* is diagrammatically illustrated in the form of a snake-like structure. A laminated construction is indicated for the shell 11 although in actual fact there are about ten thin layers instead of the three thick ones shown. The solidification front 205 is situated in the entry zone of the component mold 1. The solidified alloy is polycrystalline in the base zone 3*a* and passes into a directionally crystalline phase which extends into the zone of the opening of the selector 3*b*. Columnar crystallization as shown in FIG. 2 is to be regarded as an idealization of reality. Due to the constriction of the cross-section in the selector 3*b* and the coiled shape only one of the crystals forming in the base zone 3*a* can grow through the selector 3*b* and thus act as a seed for a monocrystal phase 210.

The arrows in FIG. 2 indicate the heat flow. The latent heat liberated on solidification and the heat from the superheated melt must be removed in the downward direction to the cooling plate 50 at the solidification front 205 (arrows 301). Some of the heat is delivered to the surroundings of the mold 10 (arrows 304). The heat flow 304 to the surroundings is directed unilaterally as shown, if the mold 10 has a cluster-like structure. The heat is discharged to the cooling plate 50, on the one hand via the base zone 3*a* (arrows 302) and, on the other hand, via the shell 11 (arrows 303).

Since the cast material undergoes contraction on solidification and the subsequent cooling, a gap 56 forms between the surface of the cooling plate 50 and the casting and impairs the heat flow 302. In order that the quantity of heat dissipated via the starter 3 can be kept large, despite the gap 56, even with the small temperature gradient, the diameter selected for the base zone 3*a* is much larger than the diameter of the selector 3*b*. The base zone 3*a* is given a small height so that the gap width proportional to the height is also small.

Due to the unilateral heat dissipation 304 to the surroundings, the solidification front 205 does not extend parallel to the cooling plate but is inclined. The inclination of the solidification front 205 must be taken into account when aligning the component mold 1 in the cluster. Care must be taken to ensure—see FIG. 3*b*—that no isolated or island zones 201 form, at which the solidification front 205 prevents melt from flowing in. If an island zone 201 of this kind solidifies, increased microporosity occurs due to contraction during the phase conversion, and this means local weakening of the casting. The incidence of island zones can be prevented by using feeders, but in some cases, this effect can be achieved much more easily by a different orientation of the component mold 1 as shown in FIG. 3*a*.

The inclination of the solidification front 205 or, more generally, its shape, which does not need to be flat, can be accurately controlled by a special configuration and arrangement of the cavities 2*a*, 2*b* or, rather, of the heat reservoirs resulting therefrom, in order to counteract the formation of island zones 201. However, the production of the heat reservoirs means extra alloy requirements, and this can be relatively expensive. For the purpose of melt economy, the mold 10 is heated in an oven to a temperature which is much higher than the liquidus temperature. As a result, the mold 10 acquires the property of a heat source. The significance as an additional heat source can be increased if, for example, a ceramic member of high thermal capacity is integrated into the shell 11 instead of the cavity 2*b*. The heat stored in this ceramic member when supplied in the oven obviously provides a corresponding saving in terms of melt.

The essential features of the process will now be explained in detail with reference to the diagram shown in FIG. 4. The insulated mold 10 is made in accordance with known method steps and need not be described here. Immediately before casting, the mold 10 is heated in a separate heating-up oven 40 to a temperature of about 1500° C. At the same time, the alloy is melted in a crucible 20 by means of an induction oven 30 within a vacuum casting plant and heated to about 200°-350° K —depending upon the alloy and the shape of the component—above the liquidus temperature. The heated mold 10 is then conveyed from the oven 40 into a lock 120 of the casting plant 100 by means of an automatic carriage 60 running on a rail 62 and a gripper 65.

The cooling plate 50 (not shown) is situated in the lock 120, the latter having doors 125 and 126. The gripper 65 must be able to perform a rotary movement when placing the mold 10 on the cooling plate 50 so that claw projections (not shown) at the edge of the circular cooling plate engage bayonet-fashion with the grooves formed in the ring 15 of the mold 10.

After evacuation of the lock 120, the cooling plate 50 together with the mold 10 fixed thereon is moved by suitable means (not shown) in the direction of the arrow into the casting chamber 130. Cooling of the plate 50 is preferably by means of water, for which inlet and outlet connections 51, 52 are provided. Means (not shown) can be used to pour the superheated melt from the crucible 20 into the hopper 7 of the mold 10. The melt fills the mold shell and, in the starter, comes into contact with the cooling plate 50. As a result of the shock-like cooling, seed crystals spontaneously form at the interface, followed by the above-mentioned polycrystalline phase in the base zones.

The separate heating of the mold 10 is advantageously carried out in two stages. Preheating is carried out in a first oven (not shown) to a temperature between about 1000° and 1200° C., and further heating to about 1500° C. is carried out in a second oven 40. The residence times in the two ovens are about an hour in each case. A ceramic firing kiln can be used for the oven 40 and be adapted to the purposes of the process. Heating can be carried out, for example, by means of gaseous hydrocarbons 45, more particularly propane. Of course, heating can also be provided by electric furnaces, particularly in the first stage.

To keep the heat losses tolerable during transport of the mold 10 to the vacuum casting plant 100, handling by the carriage 60 and entry to the lock 120 must be carried out within a maximum of two minutes. There is no need for the mold 10 to be at the same temperature as the superheated melt. It is sufficient for the temperature difference between the melt and the mold to be of the order of about 50° K at the start of casting, the temperature of the shell 11 of course being higher than the liquidus temperature.

Since heating of the mold 10 is carried out separately and not in the vacuum casting plant as in processes with additional heating means, the cycle times are much shorter. They are 10 to 30 minutes as compared with 60 to 150 minutes in other processes.

The exemplified embodiment described relates to the production of castings by monocrystalline solidification. It is possible to produce directionally solidified castings by the same process; the sole difference is that the selectors 3*b* are absent from the mold.

The invention thus provides a casting process which is particularly suitable for small components having dimensions in which the direction of the unidirectional heat flow is smaller than about 15 centiments (cm).

The invention further provides a process which does not require additional melt in order to provide for a heat sink within the casting mold.

What is claimed is:

1. A casting process comprising the steps of:

forming a superheated melt of a casting material by heating the casting material to a temperature of at least 200° K higher than the liquidus temperature of the melt;

heating an insulated mold for a casting to a temperature at least 50° K higher than the liquidus temperature of the melt, wherein the mold is open at the top and bottom and includes an insulative cover and a plurality of heat reservoirs and wherein the insulative cover includes a plurality of cavities which are adapted to house the heat reservoirs;

placing the heated mold on a cooling plate defining a heat sink so that a bottom portion of the mold is proximate to the cooling plate; and thereafter, pouring the superheated melt into the heated mold, so that, at all times during solidification, the heat flow from the melt and the mold to the cooling plate and the surroundings is substantially completely controlled by the configuration of the heat reservoirs and the configuration and insulative properties of the insulative cover such that the solidification front is guided from the bottom portion of the mold to a top portion of the mold.

2. A process as set forth in claim 1, wherein the mold is heated in a heating-up oven and is subsequently placed in a casting plant for pouring of the melt therein.

3. A process as set forth in claim 2 wherein the oven is a gas oven employing a propane heating gas.

4. A process as set forth in claim 2 wherein the mold is preheated to a temperature between 1000° C. and 1200° C. prior to being placed in the oven and subsequently heated to a temperature of about 1500° C.

5. A process as set forth in claim 4 wherein the mold is preheated in a ceramic firing kiln.

6. In combination:

a mold for receiving a melt, the mold being open at the top and bottom and wherein the mold includes an insulative cover and a plurality of heat reservoirs, the insulative cover including a plurality of cavities which are adapted to house the heat reservoirs;

a first oven for heating the mold to a temperature at least 50° K higher than the liquidus temperature of the melt;

a vacuum casting plant spaced from the first oven and having an induction oven for melting a metal alloy to form a melt thereof and to heat the melt to a temperature at least 200° K higher than the liquidus temperature of the melt and a lock for receiving the mold;

means for moving the heated mold into the lock;

a cooling plate for receiving the mold thereon in the lock; and a crucible in the plant for holding the melt in the induction oven and for pouring the melt into the mold after movement of the mold from the lock to a location adjacent to the induction oven;

wherein, at all times during the solidification of the melt, substantially all of the heat supplied to the melt is supplied from sources within the mold.

7. The combination as set forth in claim 6 wherein said means includes a gripping device for gripping said mold to said first oven and a carriage for moving said gripper device from said first oven to said lock.

8. The combination as set forth in claim 7 wherein said gripper device is rotatable to effect rotation of said mold on said cooling plate to effect a bayonet connection therebetween.

9. The combination as set forth in claim 7 wherein said mold includes a shell and high thermal-capacity members integrated into said shell.

* * * * *

UNITED STATES PATENT AND TRADEMARK OFFICE

CERTIFICATE OF CORRECTION

PATENT NO. : 5,275,227

DATED : January 4, 1994

INVENTOR(S) : Fritz Staub

It is certified that error appears in the above-indentified patent and that said Letters Patent is hereby corrected as shown below:

Column 3, line 12, change "I1" to --11--;

Column 3, line 14, change "sell" to --shell--.

Signed and Sealed this

Twenty-first Day of February, 1995

*Attest:*

*Attesting Officer*

BRUCE LEHMAN

*Commissioner of Patents and Trademarks*